US007155021B2

(12) United States Patent
Corynen

(10) Patent No.: US 7,155,021 B2
(45) **Date of Patent: *Dec. 26, 2006**

(54) LOUDSPEAKER HAVING AN ACOUSTIC PANEL AND AN ELECTRICAL DRIVER

(75) Inventor: David Magda Eddy Corynen, Dendermonde (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 1013 days.

This patent is subject to a terminal disclaimer.

(21) Appl. No.: 09/803,327

(22) Filed: Mar. 9, 2001

(65) Prior Publication Data

US 2001/0038701 A1 Nov. 8, 2001

(30) Foreign Application Priority Data

May 8, 2000 (EP) ..... 00201647

(51) Int. Cl.
*H04R 25/00* (2006.01)
*H04R 1/02* (2006.01)
*H04R 1/20* (2006.01)

(52) U.S. Cl. ..... 381/152; 381/347; 381/348; 381/395; 381/423; 181/160; 181/161; 181/199; 181/166

(58) Field of Classification Search ..... 181/157, 181/161, 163, 173, 199, 164–166, 160; 381/177, 381/184, 185, 186, 398, 353, 401–405, 423, 381/424, 431, 425, 162
See application file for complete search history.

(56) References Cited

U.S. PATENT DOCUMENTS

| | | | | | |
|---|---|---|---|---|---|
| 3,247,925 | A * | 4/1966 | Warnaka | 381/398 |
| 3,347,335 | A * | 10/1967 | Watters et al. | 381/354 |
| 3,603,427 | A * | 9/1971 | Sotome | 181/166 |
| 6,144,746 | A * | 11/2000 | Azima et al. | 381/152 |
| 6,176,345 | B1 * | 1/2001 | Perkins et al. | 181/173 |
| 6,282,298 | B1 * | 8/2001 | Azima et al. | 381/423 |
| 6,324,052 | B1 * | 11/2001 | Azima et al. | 361/683 |
| 6,411,723 | B1 * | 6/2002 | Lock et al. | 381/431 |
| 6,519,346 | B1 * | 2/2003 | Asada et al. | 381/152 |
| 6,590,993 | B1 * | 7/2003 | D'Hoogh et al. | 381/431 |
| 2003/0007653 | A1 * | 1/2003 | Azima et al. | 381/152 |

FOREIGN PATENT DOCUMENTS

| | | |
|---|---|---|
| GB | 1557879 | 12/1979 |
| WO | WO9709840 | 9/1996 |
| WO | 9709842 A2 | 3/1997 |
| WO | 9967974 A1 | 12/1999 |

* cited by examiner

*Primary Examiner*—Suhan Ni
*Assistant Examiner*—Dionne Pendleton
(74) *Attorney, Agent, or Firm*—Edward W. Goodman

(57) ABSTRACT

A panel-shaped loudspeaker comprising a panel (1) having a first main surface (1A) and a second main surface (1B) parallel to the first main surface and further comprising an exciter (3) positioned at the first main surface. When the exciter is energized the panel is capable of sustaining bending waves and has a distribution of resonant modes of its natural bending wave vibration, which results in an acoustic radiation. The loudspeaker has a tuning element (17) extending near the second main surface of the panel and positioned opposite the exciter so as to form a resonant cavity (18) between the panel and the exciter.

10 Claims, 7 Drawing Sheets

LOUDSPEAKER HAVING AN ACOUSTIC PANEL AND AN ELECTRICAL DRIVER

Figure 1:
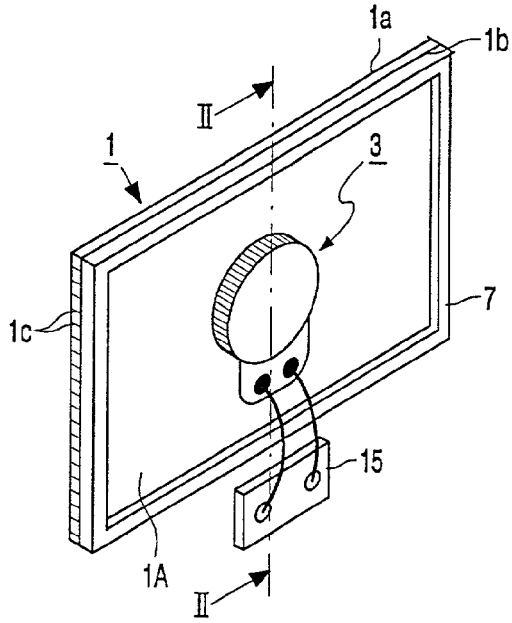

The invention relates to a loudspeaker comprising an acoustic panel having a first main surface and, extending substantially parallel thereto, a second main surface and comprising an electrical exciter arranged on the first main surface, the panel producing acoustic radiation upon energization of the exciter, at least subsequently as a result of bending waves produced in the panel.

PCT patent application WO-A 99/67974 discloses a loudspeaker having an anisotropic plane or slightly curved diaphragm formed from two skins and a structure which extends between said skins. The diaphragm has a longitudinal bending strength which is greater than the transverse bending strength. An extruded diaphragm of a polypropylene co-polymer having walls which extend between the skins is mentioned as a possible version. The diaphragm carries one or more exciters.

PCT patent application WO-A 97/09842 discloses a panel-shaped loudspeaker, which has a panel comprising a sandwich-like structure and a rigid cellular core, particularly a honeycomb structure, and two skins enclosing the core and glued to the core. A light metal and a synthetic material are mentioned as materials for the core. The loudspeaker further has one or more exciters arranged at such locations with respect to the panel that bending waves are produced in the panel at given frequencies, which results in an irregular pattern of regions with more and regions with less vibration activity, which is characteristic of the loudspeaker of the type to which the present patent document relates and which is commonly referred to as a flat-panel loudspeaker.

It has been found that the known panel-shaped loudspeakers have only a poor acoustical performance, particularly in the upper part of the audio frequency range. Measurements have revealed that the average sound pressure at higher frequencies, i.e. of the order of 5 kHz and higher, is significantly lower than the average sound pressure at midrange frequencies, i.e. of the order of 350–5000 Hz. This is why to date the acoustical performance of panel-shaped loudspeakers falls short of the acoustical performance of conventional loudspeakers based on piston action and generally having conical diaphragms.

It is an object of the invention to provide a panel-shaped loudspeaker of the type defined in the opening paragraph, which during use in the upper part of the audible frequency range produces an average sound pressure corresponding to the average sound pressure in the mid-frequency range or which at least closely approximates thereto.

This object is achieved with the loudspeaker according to the invention, which is characterized in that the loudspeaker has a tuning element disposed near the second main surface and extending at least partly opposite the exciter, so as to form a resonant cavity between the panel and the tuning element. Listening tests have revealed that the applied measure yields a substantial improvement of the reproduced sound. Measurements have shown that the measure does not or not significantly affects the sound pressure at the midrange frequencies but that particularly at higher frequencies the average sound pressure can increase or even rise beyond a value corresponding the value of the average sound pressure at the mid-range frequencies.

In a simple embodiment the tuning element is disc-shaped and the disc-shaped tuning element extends at least subsequently parallel to the panel. Listening tests have revealed that an annular tuning element, which consequently has a central opening, may lead to a further improvement in sound quality. Measurements performed on an embodiment having a disc-shaped tuning element which extends at least substantially parallel to the panel reveal an excellent balance between the average sound pressure at the mid-range frequencies and the average sound pressure at the higher frequencies.

An embodiment of the loudspeaker in accordance with the invention is characterized in that the tuning element is secured to the panel. This guarantees a constant distance between the tuning element and the panel because the tuning element can follow an excursions of the panel, i.e. the volume of the resonant cavity is not dependent on the instantaneous position of the panel. The tuning element itself may be provided with suitable means for securing it to the panel, or use is made of separate means.

Satisfactory results have been obtained with the embodiment in which a shortest distance in the range from 1 to 4 mm exists between the tuning element and the panel.

An embodiment that is attractive from an esthetic point of view is characterized as defined in claim 6. This embodiment also has manufacturing advantages.

An embodiment of the loudspeaker in accordance with the invention is characterized in that panel has two interconnected walls which extend at least substantially parallel to one another and has a structure of strip-shaped partitions extending between the walls of the panel, the longitudinal axes of all of said partitions extending at least parallel to each other and parallel to the walls, said partitions being further secured to the walls, the walls and the partitions being made of a material which, used in the panel, has an internal damping which is at least 2.5% of the critical damping of the relevant material, used in the panel.

The panel of the loudspeaker according to the invention in the embodiment defined hereinbefore is mechanically anisotropic, which panel has a comparatively low resistance to bending about an axis parallel to said longitudinal axes and has a comparatively high resistance to bending about an axis oriented transversely thereto. This embodiment has a favorable acoustical behavior throughout the audio frequency range, i.e. at low frequencies, at mid-range frequencies as well as at high frequencies. It has been found by experiment that natural resonances already occur at relatively low frequencies in the panel used. It is preferable not to exceed an internal damping of maximum 10% so as to avoid any negative effects which may occur with larger dampings at higher frequencies. A very favorable acoustical behavior through a wide frequency range was found at an internal damping of 3% of the critical damping.

An embodiment of the loudspeaker according to the invention is characterized in that the partitions extend at least substantially parallel to one another and extend at least substantially perpendicularly to the walls, as a result of which an optimum anisotropy can be achieved. It is then practical if the material of the walls is identical to the material of the partitions. Preferably, the walls and the partitions adjoin one another seamlessly. In such an embodiment, the walls and partitions constitute an integral unit which can be manufactured, for example, by means of extrusion. Such a panel can be manufactured in a simple manner and at low cost. A suitable material for the walls and the partitions of the panel is a polypropylene, preferably a co-polymer of polypropylene.

An extruded double-walled plate of polypropylene copolymer is, in itself, commercially available. The loudspeaker in accordance with the invention may have a frame, to which the panel is connected with the aid of connecting means such as for example a plurality of discrete hard mounting projections. For a further improvement of the acoustical behavior of the loudspeaker a few strips of a soft material may be interposed between the panel and the frame. This connecting method has some drawbacks. First of all, the positions of the projections with respect to the panel should be determined accurately and, in addition, mounting and connecting both the projections and the strips is laborious. Moreover, the connection, usually an adhesive joint, of the generally comparatively small projections is not always reliable in the long run. Tests have revealed that a favorable connection of a panel to a frame of a panel-shaped loudspeaker is obtained if a, preferably fully closed, annular strip of a soft material is interposed between a circumferential edge portion of the panel and a, preferably facing, portion of the frame. It has been found that such an inherently simple compliant connection, which is comparatively unsusceptible to tolerances, has not only advantages as regards production and lifetime but also has a favorable effect on the acoustical behavior of the loudspeaker. Said strip is preferably secured both to the circumferential edge portion of the panel and to said portion of the frame by means of an adhesive such as a glue. A suitable soft material is, for example, soft rubber.

The loudspeaker in accordance with the invention may further have rear wall which extends at least substantially parallel to the panel and which in conjunction with the panel forms a chamber, the rear wall being imperforate for the greater part. Tests have revealed that such a wall can provide a further improvement of the balance between the sound at low and mid-range frequencies and the sound at high frequencies. To achieve this, the rear wall is preferably formed with one or more frequency-tuned apertures, both the open rear wall portion or rear wall portions formed by the aperture or apertures and the position or positions of the aperture or the apertures having an influence on the sound balance. The sound balance for a given panel can be optimized by varying one or both aspects.

With reference to the claims, it is to be noted that various combinations of characteristic features defined in the claims are possible.

Figure 2:
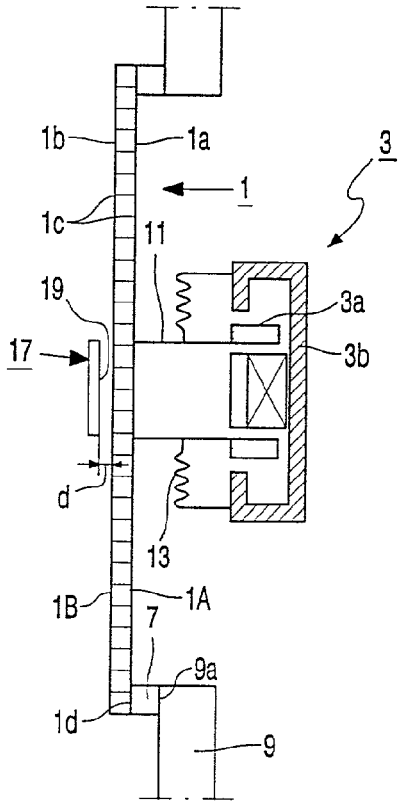
Figure 3:
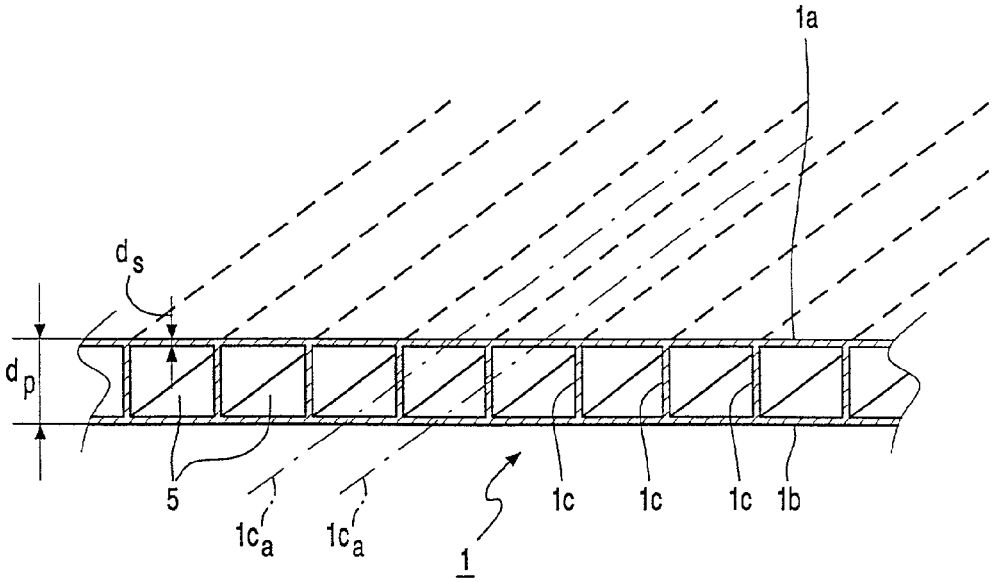

The invention will now be described in more detail, by way of example, with reference to the drawings, in which:

FIG. 1 is a diagrammatic rear view of a first embodiment of the loudspeaker in accordance with the invention, FIG. 2 shows diagrammatically the first embodiment shown in FIG. 1 (secured to a frame) in a cross-sectional view taken on the line II—II in FIG. 1, and FIG. 3 is a cross-sectional view taken on the line II—II, which shows a part of the panel of the first embodiment diagrammatically and to an enlarged scale.

Figure 4:
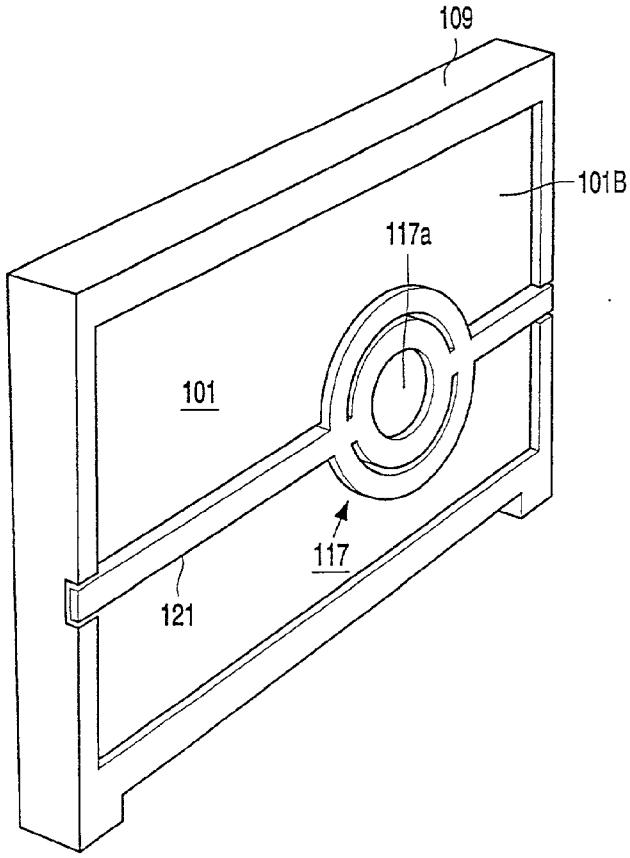
Figure 5:
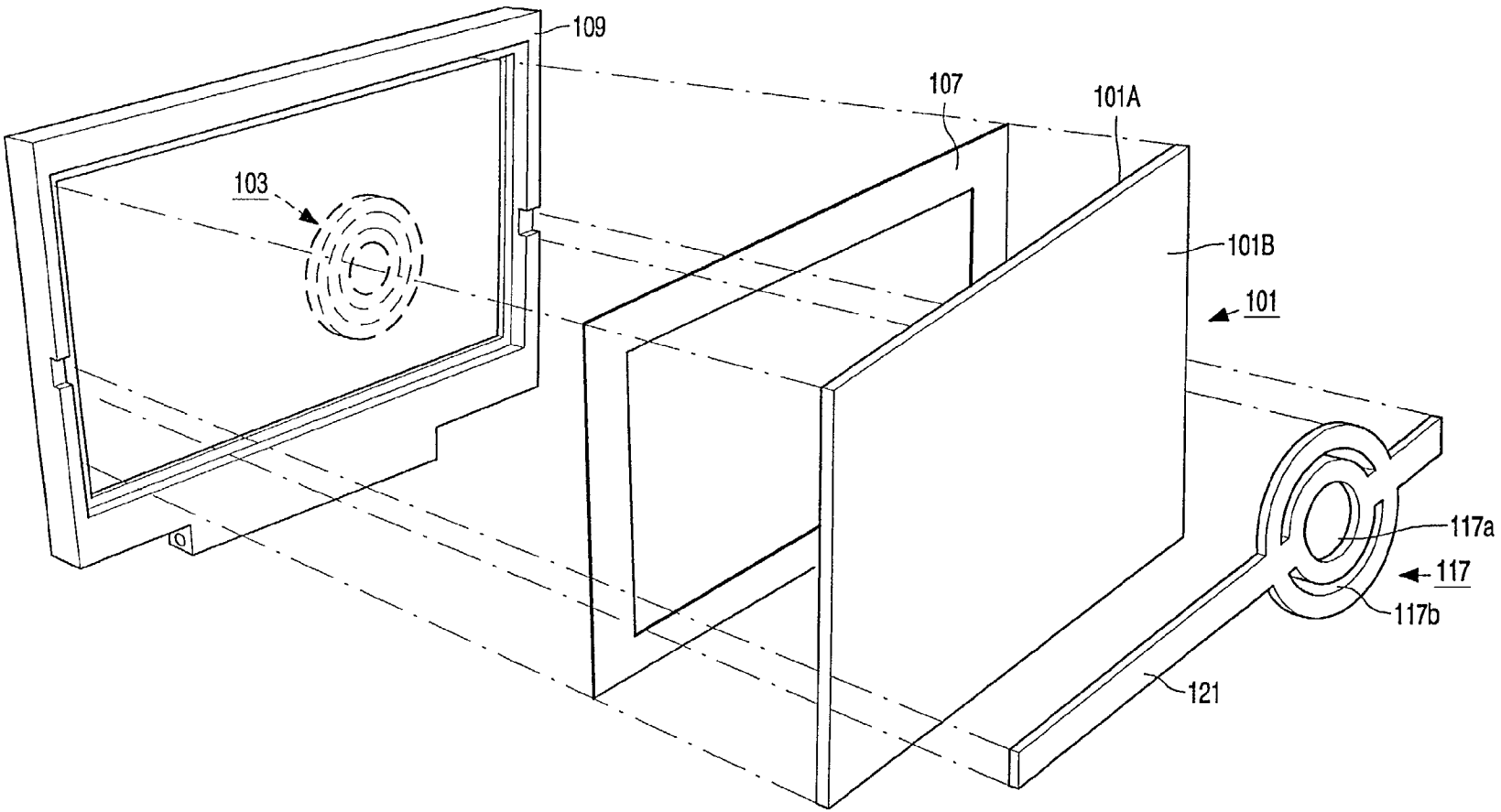
Figure 6:
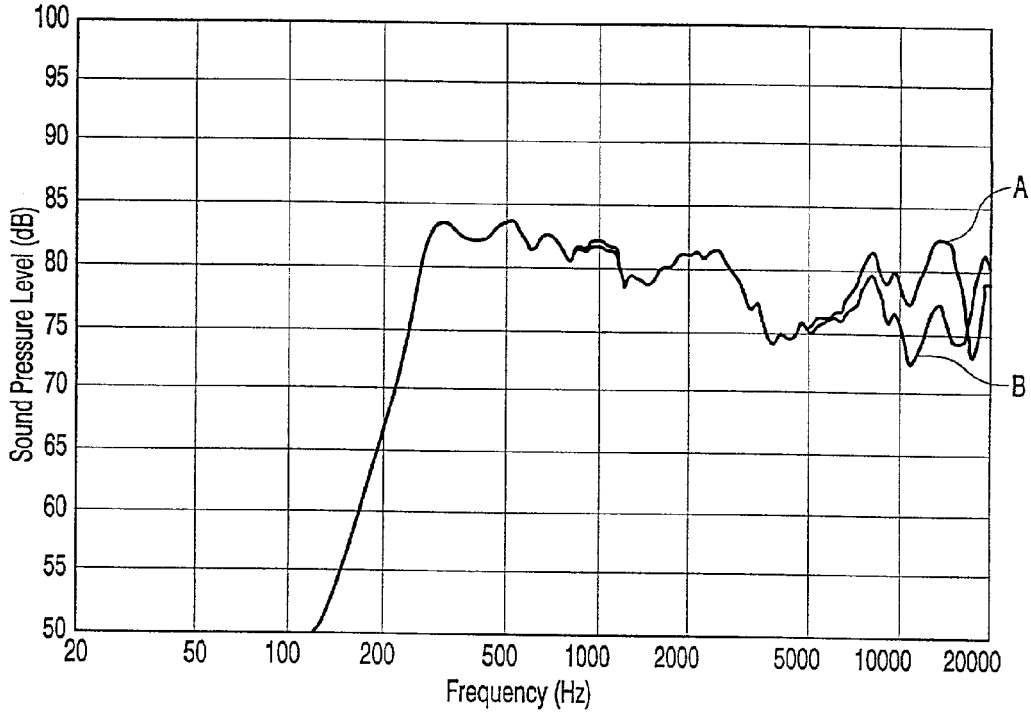
Figure 7:
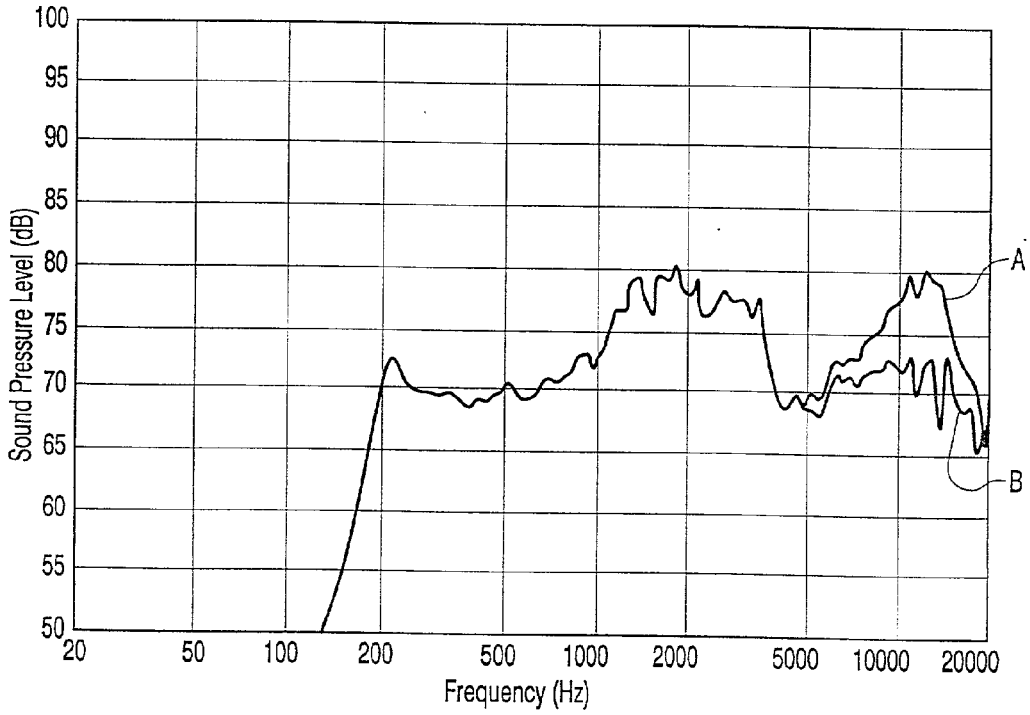
Figure 8:
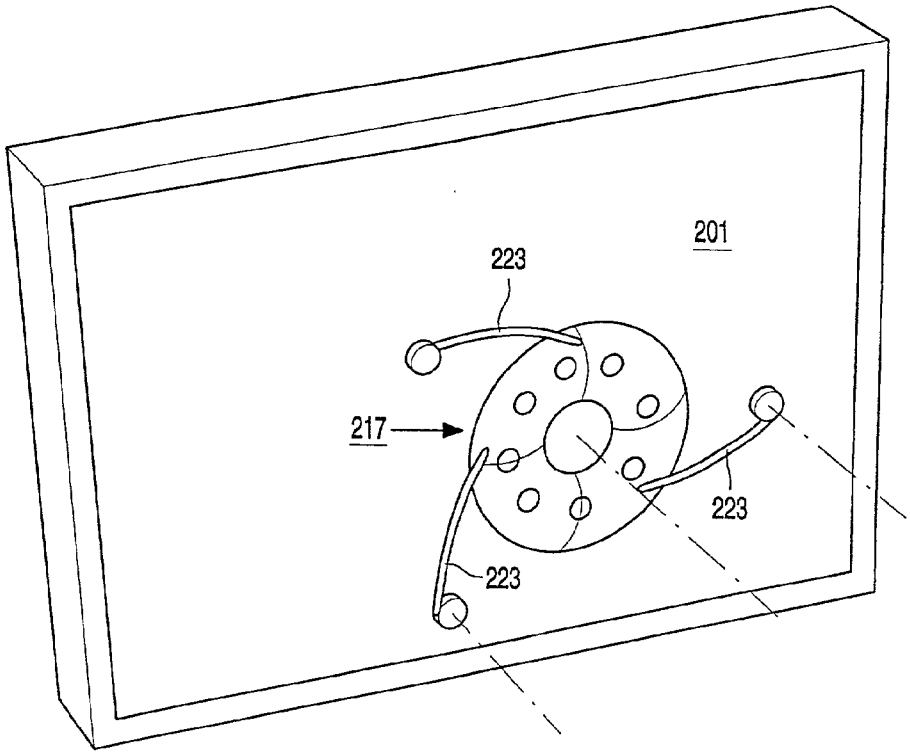
Figure 9:
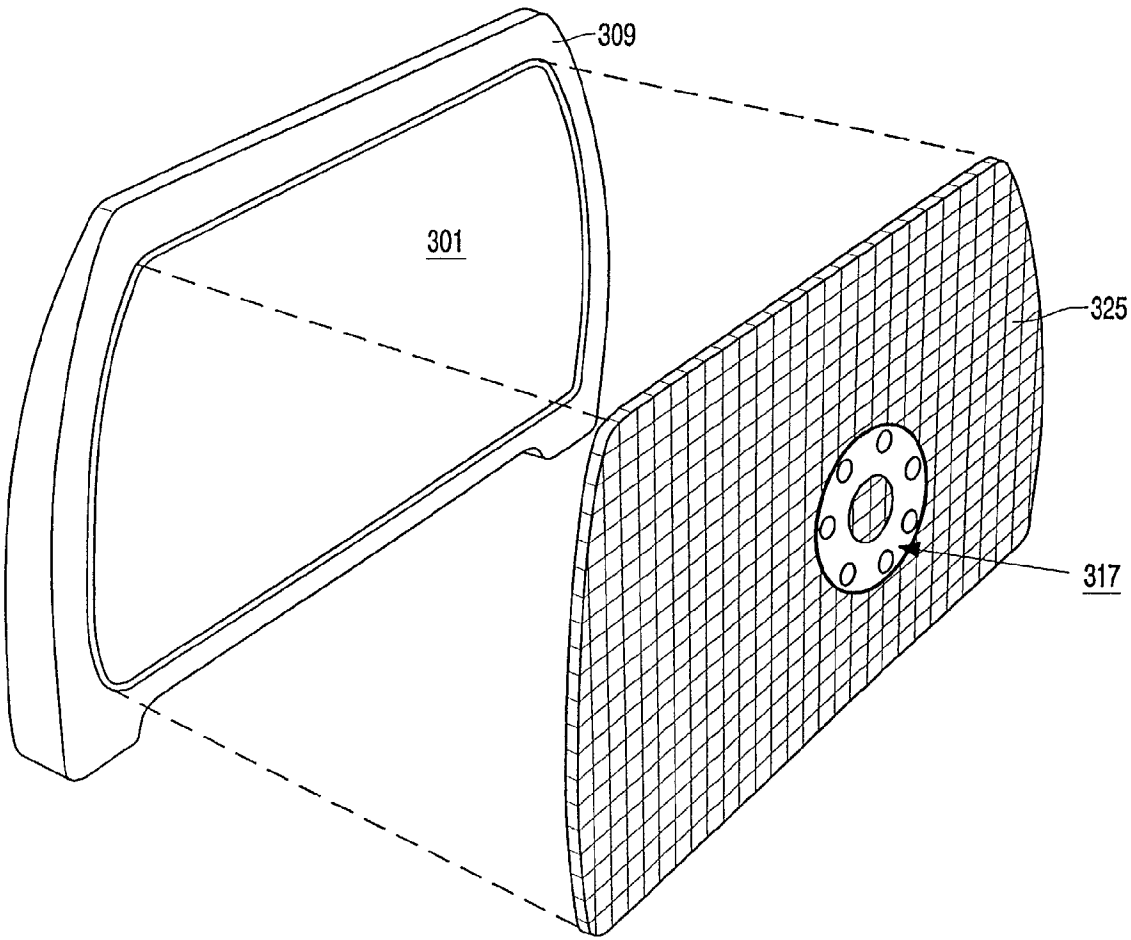
Figure 10:
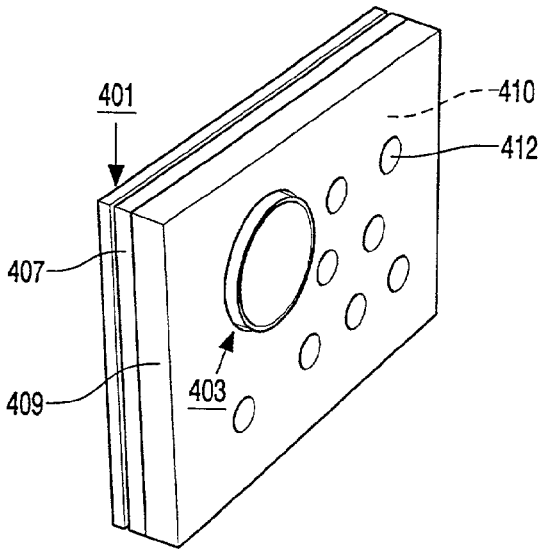
Figure 11:
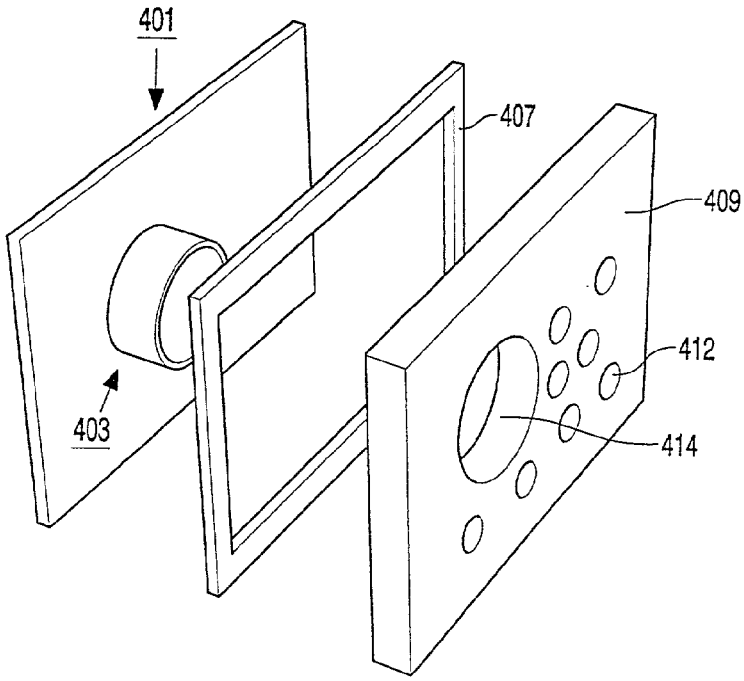

FIG. 4 is a diagrammatic front view of a second embodiment of the loudspeaker in accordance with the invention, FIG. 5 is a diagrammatic exploded view of the second embodiment, FIG. 6 shows a first graphical representation of measurement results, FIG. 7 shows a second graphical representation of measurement results, FIG. 8 is a diagrammatic front view of a third embodiment of the loudspeaker in accordance with the invention, FIG. 9 is a diagrammatic front view of a fourth embodiment of the loudspeaker in accordance with the invention shown in a disassembled condition, FIG. 10 is a diagrammatic rear view of a fifth embodiment of the loudspeaker in accordance with the invention, and FIG. 11 is a diagrammatic exploded view of the fifth embodiment.

The embodiment of the panel-shaped loudspeaker shown in FIGS. 1, 2 and 3 has a panel 1, particularly a flat panel, and an exciter 3 for driving the panel 1 coupled to the exciter 3. The panel 1 has two thin walls 1*a* and 1*b*, which each define a main surface 1A and 1B, respectively. The panel 1 further has a structure of thin strip-shaped partitions 1*c* situated between the two walls 1*a* and 1*b* and interconnecting the walls 1*a* and 1*b*.

The partitions 1*c* are oriented transversely to the walls 1*a* and 1*b* and the longitudinal axes $1c_a$ of all of these partitions extend parallel to each other and parallel to the walls 1*a* and 1*b*. In the present example, the walls 1*a* and 1*b* and the partitions 1*c* form one product, notably an extrusion product, formed from a polypropylene co-polymer. In the application shown, this material has an internal damping of 2.9%. In this example, the panel 1 has a thickness $d_p$ of 1.5 mm and the walls 1*a* and 1*b* and the partitions 1*c* have a thickness $d_s$ of 0.3 mm.

In this example, the walls 1*a* and 1*b* together with the partitions 1*c* constitute parallel channels 5 having a rectangular, substantially square, cross-section. The panel 1 has an anisotropic bending stiffness. If additional damping is desired, a damping material such as a polyurethane foam may be selectively provided in the channels.

In this example, the panel 1 is secured to a frame 9 by means of a compliant strip 7 of a soft material. The strip 7, which follows the outlines of the panel 1, has one side glued to n a circumferential wall portion 1*d* of the panel and has its other side glued to a portion 9*a* of the frame 9, which last-mentioned portion faces the wall portion 1*d*. The soft material is soft rubber.

The exciter 3 is disposed near the main surface 1A, also referred to as the first main surface in the present document, and in the present example it is provided with an electromagnetic exciter system comprising an exciter coil 3*a* on a coil former 11, secured to the panel 1, and a magnetic unit 3*b* cooperating therewith through an air gap. The magnetic unit 3*b* comprises a permanent magnet and a magnetic yoke and is suspended to the coil former 11 by means of a resilient suspension means 13. The exciter 3 has electrical connection means 15.

Near the main surface 1B, also referred to as the second main surface in the present document, the loudspeaker has a tuning element 17, which in the present example takes the form of a disc-shaped element. The tuning element 17, which is spaced at a distance d from the wall 1*b*, forms a resonant cavity 19 with the panel 1.

The embodiment of the loudspeaker in accordance with the invention shown in FIGS. 4 and 5 has a panel 101 having a first main surface 101A and, extending parallel thereto, a second main surface 101B. The loudspeaker further has an electrical exciter 103, disposed on the first main surface 101A, for driving the panel 101.

The exciter 103 is arranged in such a manner with respect to the panel 101 and the panel 101 is of such a structure that upon energization of the exciter 103 such a pattern of bending waves is generated in the panel 101 that a characteristic irregular yet reproducible pattern of regions with more vibration activity and regions with less vibration activity is produced, which results in an acoustic radiation from the second main surface 101B of the panel 101.

The loudspeaker further has a tuning element 117, which extends near the second main surface 101B and at least opposite the exciter 103, for the formation of a resonant cavity between the panel 101 and the tuning element 117. In the present example, the tuning element 117 is an annular element having a central opening 117*a* and, if this is desired for the tuning as regards frequency and bandwidth, having recesses 117*b* in the form of circle fragments, small apertures and the like. If desired, a damping material may be provided in the recesses.

The loudspeaker shown in FIGS. 4 and 5 has a frame 109 to which the panel 101 is secured by means of a resilient suspension ring 107. The tuning element 117 in the present example forms an integral unit with a bracket 121 secured to the frame 109.

The graphical representation in FIG. 6 shows the results of sound pressure measurements carried out at different frequencies on a loudspeaker embodying the invention and on a loudspeaker without a tuning element. In both cases the panel in accordance with the invention corresponds to the panel 101 as used in the embodiment shown in FIGS. 1, 2 and 3. In the representation of FIG. 6 the sound pressure level in dB is plotted along the vertical axis and the frequency in Hz is plotted along the horizontal axis. The curve A represents the results of measurement carried out on the loudspeaker embodying the invention and the curve B represents the results of measurements carried out on the same loudspeaker after removal of the tuning element. The measurement clearly show that the sound pressure in the high frequency region from 5000 Hz is significantly higher when the tuning element is present.

FIG. 7 shows a similar representation but in this case the results are results of measurements on loudspeakers having a panel of glass-fiber-reinforced epoxy. The curve A again represents the results of measurements carried out on a loudspeaker embodying the invention, i.e. a loudspeaker having a tuning element. The curve B again represents the results of measurements carried out after the tuning element has been removed. This experiment also reveals a distinct increase of the sound pressure in the upper frequency range when a resonant cavity is present.

In the embodiment of the loudspeaker in accordance with the invention shown in FIG. 8 the tuning element 217 is secured to the panel 201 with the aid of a suspension means. The suspension means is formed, by way of example, by three wire-shaped suspension elements 223; obviously, other means are possible. If desired, a resilient and/or damping means may be interposed between the suspension means and the panel.

The embodiment of the loudspeaker in accordance with the invention shown in FIG. 9 has a cover, in the present example in the form of a grille 325, which extends parallel to the panel 301. The tuning element 317 is integrated in the grille 325, which like the panel 301 is secured to the frame 309.

The panel-shaped loudspeaker in accordance with the invention shown in FIGS. 10 and 11 has a panel 401, which is of a flat construction. If desired, the panel may be bent or curved to some degree. The panel 401 carries an exciter 403. The loudspeaker further has a frame, which extends parallel to the panel 401 and which also serves as a rear wall 409. The panel 1 and the rear wall 409 are connected to one another and together form a chamber 410, the rear wall 409 being formed with a pattern of apertures 412 for the purpose of tuning the loudspeaker. In the present example the panel 401 and the rear wall 409 are connected to one another by means of a resilient connecting strip 407, which is secured, in this particular case glued, both to the panel 401 and to the rear wall 409. Obviously, the panel 401 may also be secured to the rear wall 409 in a different manner. In the present example the distance between the panel 401 and the rear wall 409 is approximately 3 mm. On account of this small distance the rear wall 409 is formed with an additional aperture 414 to accommodate the exciter 403. When a very flat exciter is used or when the depth of the chamber is larger such an aperture may be dispensed with.

It is to be noted that the invention is not limited to the embodiments of the panel-shaped loudspeaker in accordance with the invention as shown herein. For example, several variants are possible within the scope of the invention, notably as regards shape, size, location of the exciter and choice of material. It is essential that a tuning element is disposed opposite the exciter at a suitable distance from the panel. The exciter may be centered of off-centered with respect to the panel. Moreover, the loudspeaker may be provided with more than one exciter. In that case tuning elements may be arranged opposite all the exciters then provided. Furthermore, an exciter system of a different type, particularly of a piezoelectric type, may be used instead of an electromagnetic exciter system.

The loudspeaker in accordance with the invention may be used in audio, video and multimedia systems. The loudspeaker may also be used as a car loudspeaker and as a conference loudspeaker.

The invention claimed is:

1. A loudspeaker comprising:

an acoustic panel having a first main surface and, extending substantially parallel thereto, a second main surface;

an electrical exciter positioned on a side of said acoustic panel comprising said first main surface and arranged on the first main surface, the acoustic panel producing acoustic radiation upon energization of the exciter, at least subsequently as a result of bending waves produced in the acoustic panel; and a tuning element positioned on a side of said acoustic panel comprising said second main surface, disposed near the second main surface and extending at least partly opposite the exciter, said tuning element forming a resonant cavity with the acoustic panel.

2. The loudspeaker as claimed in claim 1, characterized in that the tuning element is disc-shaped and extends at least substantially parallel to the acoustic panel.

3. The loudspeaker as claimed in claim 1, characterized in that the tuning element is annular and extends at least substantially parallel to the acoustic panel.

4. The loudspeaker as claimed in claim 1, characterized in that the tuning element is secured to the acoustic panel.

5. The loudspeaker as claimed in claim 1, characterized in that a shortest distance in the range from 1 to 4 mm exists between the tuning element and the acoustic panel.

6. The loudspeaker as claimed in claim 1, characterized in that, positioned on a side of said acoustic panel comprising said second main surface and disposed near the second main surface, the loudspeaker further comprises an acoustically transparent cover extending at least substantially parallel to the acoustic panel, the tuning element being integrated in the cover.

7. A loudspeaker comprising:

an acoustic panel having a first main surface and, extending substantially parallel thereto, a second main surface;

an electrical exciter positioned on a side of said acoustic panel comprising said first main surface and arranged on the first main surface, the acoustic panel producing acoustic radiation upon energization of the exciter, at least subsequently as a result of bending waves produced in the acoustic panel; and a tuning element positioned on a side of said acoustic panel comprising said second main surface, disposed near the second main surface and extending at least partly opposite the exciter, said tuning element forming a resonant cavity with the acoustic panel, characterized in that the acoustic panel comprises two walls extending at least substantially parallel to each other and connected to each other, and comprises a structure of strip-shaped partitions extending between the walls of the acoustic panel, each of said strip-shaped partitions having a longitudinal axis and the longitudinal axes of all of said strip-shaped partitions extending at least parallel to each other and parallel to the walls, said strip-shaped partitions being further secured to the walls, the walls and the strip-shaped partitions being made of a material which, used in the acoustic panel, has an internal damping which is at least 2.5% of the critical damping of the relevant material, used in the acoustic panel.

8. The loudspeaker as claimed in claim 7, characterized in that the strip-shaped partitions extend at least substantially parallel to each other and extend at least substantially perpendicularly to the walls.

9. The loudspeaker as claimed in claim 1, characterized in that the loudspeaker has a frame, the acoustic panel being connected to the frame with the aid of connecting means, the connecting means comprising an annular strip of a soft material, said annular strip being interposed between a circumferential edge portion of the acoustic panel and a portion of the frame.

10. The loudspeaker as claimed in claim 1, characterized in that the loudspeaker has a rear wall extending at least substantially parallel to the acoustic panel, said rear wall forming a cavity with the acoustic panel, the rear wall being formed with one or more frequency-tuned apertures.

* * * * *